US011071183B2

(12) United States Patent
Chen et al.

(10) Patent No.: US 11,071,183 B2
(45) Date of Patent: Jul. 20, 2021

(54) LIGHTING APPARATUS

(71) Applicant: XIAMEN LEEDARSON LIGHTING CO.LTD., Fujian (CN)

(72) Inventors: Hongji Chen, Fujian (CN); Hongbu Lin, Fujian (CN); Jianhui Cao, Fujian (CN)

(73) Assignee: XIAMEN LEEDARSON LIGHTING CO.LTD., Xiamen (CN)

( * ) Notice: Subject to any disclaimer, the term of this patent is extended or adjusted under 35 U.S.C. 154(b) by 0 days.

(21) Appl. No.: 16/908,111

(22) Filed: Jun. 22, 2020

(65) Prior Publication Data

US 2020/0404760 A1 Dec. 24, 2020

(30) Foreign Application Priority Data

Jun. 21, 2019 (CN) ..... 201920940760.9

(51) Int. Cl.

| | |
|---|---|
| ***H05B 45/14*** | (2020.01) |
| ***H05B 45/24*** | (2020.01) |
| ***H05B 45/34*** | (2020.01) |
| ***H05B 45/325*** | (2020.01) |
| ***H05B 47/19*** | (2020.01) |
| ***H05B 45/345*** | (2020.01) |

(52) U.S. Cl.

CPC ..... *H05B 45/34* (2020.01); *H05B 45/14* (2020.01); *H05B 45/24* (2020.01); *H05B 45/325* (2020.01); *H05B 45/345* (2020.01); *H05B 47/19* (2020.01)

(58) Field of Classification Search

CPC ..... H05B 45/00; H05B 45/10; H05B 45/14; H05B 45/19; H05B 45/24; H05B 45/325; H05B 45/34; H05B 45/345

See application file for complete search history.

(56) References Cited

U.S. PATENT DOCUMENTS

2014/0117874 A1* 5/2014 Matsumoto ..... H05B 45/37 315/291
2018/0324916 A1* 11/2018 Lai ..... H05B 45/20

* cited by examiner

*Primary Examiner* — Jimmy T Vu

(74) *Attorney, Agent, or Firm* — Chun-Ming Shih; Lanway IPR Services

(57) ABSTRACT

A lighting apparatus is connected to a dimmer and an external power source. The lighting apparatus includes a light source and a driver. The driver is used for converting the external power source to a driving current supplied to the light source. The driver includes a rectifier module, a constant voltage module, a control module, a constant current module, and a power module. The rectifier module is connected to the dimmer for rectifying a dimming voltage to a rectified voltage. The constant voltage module is connected to the rectifier module for providing a first constant voltage power according to the rectified voltage.

20 Claims, 5 Drawing Sheets

LIGHTING APPARATUS

FIELD

The present invention is related to a lighting apparatus, and more particularly related to a lighting apparatus with stable driving circuits.

BACKGROUND

The time when the darkness is being lighten up by the light, human have noticed the need of lighting up this planet. Light has become one of the necessities we live with through the day and the night. During the darkness after sunset, there is no natural light, and human have been finding ways to light up the darkness with artificial light. From a torch, candles to the light we have nowadays, the use of light have been changed through decades and the development of lighting continues on.

Early human found the control of fire which is a turning point of the human history. Fire provides light to bright up the darkness that have allowed human activities to continue into the darker and colder hour of the hour after sunset. Fire gives human beings the first form of light and heat to cook food, make tools, have heat to live through cold winter and lighting to see in the dark.

Lighting is now not to be limited just for providing the light we need, but it is also for setting up the mood and atmosphere being created for an area. Proper lighting for an area needs a good combination of daylight conditions and artificial lights. There are many ways to improve lighting in a better cost and energy saving. LED lighting, a solid-state lamp that uses light-emitting diodes as the source of light, is a solution when it comes to energy-efficient lighting. LED lighting provides lower cost, energy saving and longer life span.

The major use of the light emitting diodes is for illumination. The light emitting diodes is recently used in light bulb, light strip or light tube for a longer lifetime and a lower energy consumption of the light. The light emitting diodes shows a new type of illumination which brings more convenience to our lives. Nowadays, light emitting diode light may be often seen in the market with various forms and affordable prices.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

In 1878, Thomas Edison tried to make a usable light bulb after experimenting different materials. In November 1879, Edison filed a patent for an electric lamp with a carbon filament and keep testing to find the perfect filament for his light bulb. The highest melting point of any chemical element, tungsten, was known by Edison to be an excellent material for light bulb filaments, but the machinery needed to produce super-fine tungsten wire was not available in the late 19th century. Tungsten is still the primary material used in incandescent bulb filaments today.

Early candles were made in China in about 200 BC from whale fat and rice paper wick. They were made from other materials through time, like tallow, spermaceti, colza oil and beeswax until the discovery of paraffin wax which made production of candles cheap and affordable to everyone. Wick was also improved over time that made from paper, cotton, hemp and flax with different times and ways of burning. Although not a major light source now, candles are still here as decorative items and a light source in emergency situations. They are used for celebrations such as birthdays, religious rituals, for making atmosphere and as a decor.

Illumination has been improved throughout the times. Even now, the lighting device we used today are still being improved. From the illumination of the sun to the time when human can control fire for providing illumination which changed human history, we have been improving the lighting source for a better efficiency and sense. From the invention of candle, gas lamp, electric carbon arc lamp, kerosene lamp, light bulb, fluorescent lamp to LED lamp, the improvement of illumination shows the necessity of light in human lives.

For lighting devices with dimmers to adjust light intensity, it is annoying when AC power source has jittering or unstable drop. In such case, the light pattern usually shows unstable change, which make people uncomfortable. This is particularly serious in an environment where power is not stable, e.g. using solar power or other circumstances.

Therefore, it is beneficial to design a stable driver providing a nice lighting effect for lighting devices.

SUMMARY

In some embodiments, a lighting apparatus is connected to a dimmer and an external power source. The lighting apparatus includes a light source and a driver. The driver is used for converting the external power source to a driving current supplied to the light source. The driver includes a rectifier module, a constant voltage module, a control module, a constant current module, and a power module. The rectifier module is connected to the dimmer for rectifying a dimming voltage to a rectified voltage. The constant voltage module is connected to the rectifier module for providing a first constant voltage power according to the rectified voltage. The control module is connected to the rectifier module for providing a control signal according to the rectified voltage. The constant current module is connected to the constant voltage module and the light source for providing a constant current according to the control signal and the first constant voltage power. The power module is connected to the constant voltage module for providing a supplied voltage according to the first constant voltage power source.

In some embodiments, the constant voltage module suppresses a voltage drop caused by an alternating current power source network. For example, the lighting apparatus is connected to a 110V/220V alternating power source. In some areas, the power may be unstable and sometimes there is voltage drop. When such voltage drop occurs, the dimmer is directly affected and sends an incorrect adjustment to the driver and consequently the light source is controlled to act abnormally, causing unpleasant visual effect. The constant voltage module keeps the influence of the voltage drop away from the light source even with a dimmer aside.

In some embodiments, the control signal is a PWM (Pulse Width Modulation) control signal.

In some embodiments, the control module includes a voltage input unit, a feedback unit and a control unit. The voltage input unit is connected to the rectifier module for detecting the rectified voltage to provide voltage detection signal. The feedback unit is connected to the constant current module for detecting the driving voltage to provide a feedback voltage. The control unit is connected to the voltage input unit and the feedback unit for providing the control signal according to the voltage detection signal and the feedback voltage.

In some embodiments, the feedback unit includes a sixth resistor and a seventh resistor. The sixth resistor and the seventh resistor are connected in series between the constant current module and the control unit.

In some embodiments, the feedback unit includes a sixth resistor and a seventh resistor. The sixth resistor and the seventh resistor are connected in series between the constant current module and the control unit.

In some embodiments, the control unit includes a modulus converter connected to the voltage input unit for transmitting the rectified voltage to a digital signal. The modulus converter is connected to the feedback unit for a controller providing control signal according to the digital signal and the feedback voltage.

In some embodiments, the constant voltage module includes a constant voltage chip, an eighth resistor, a ninth resistor, a tenth resistor, an eleventh resistor, a twelfth resistor, a thirteenth resistor, a first inductor, a first transistor, a second capacitor, a second LED and a third LED. The first transistor has a gate connected to a PFC (power factor correction) pin of the constant voltage chip through the eighth resistor. The ninth resistor is connected between the gate of the first transistor and an anode end of the first transistor. A cathode end of the first transistor is connected to the rectifier module through the first inductor.

The tenth resistor is connected between the anode end of first transistor and the ground, the thirteenth resistor is connected to the VBUS pin of the constant voltage chip and the ground.

The eleventh resistor and the twelfth resistor are connected in series between a first end of the second capacitor and the VBUS pin of the constant voltage chip. The first end of the of the second capacitor is connected to the negative end of the second LED. The positive end of the second LED is connected to the rectifier module. The negative end of the third LED is connected to the first end of the second capacitor, the positive end of the third LED is connected to the cathode end of the first transistor.

The second end of the second capacitor is grounded. The second end of the second capacitor is connected to the constant current module.

In some embodiments, the constant current module includes a constant current chip, a second transistor, a second inductor, a fourteenth resistor, a fifth resistor, a sixth resistor, a seventeenth resistor, an eighteenth resistor, a third capacitor and a fourth LED.

An input end of the constant current chip is connected to the control module through the fourteenth resistor. The power end of the constant current chip is connected to the power module, the output end of the constant current chip is connected to a gate of the second transistor through the fifteenth resistor. An anode end of the second transistor is grounded through the seventeenth resistor.

The sixteenth resistor is connected between the anode end of the second transistor and the gate of the second transistor.

The first end of the second inductor is connected to the cathode of the second transistor. The second end of the second inductor passes the eighteenth resistor connected to the constant voltage module. The first end of the third capacitor is connected to the constant voltage module and the anode of the LED light source. The second end of the third capacitor is connected to the second end of the second inductor and the negative end of the LED light source. The fourth LED has a positive end connected to the cathode end of the second transistor. The negative end of the fourth LED is connected to the constant voltage module 20.

In some embodiments, the power module includes a first voltage conversion unit connected to the constant voltage module for converting the first constant voltage power source to a first voltage and a second voltage conversion unit connected to the first voltage conversion module for converting the first voltage to a second voltage.

In some embodiments, the first voltage conversion unit includes a first converting chip, a third inductor, a nineteenth resistor, a twentieth resistor, a fifth LED, a sixth LED, a fourth capacitor and a fifth capacitor. The first converting chip has a D pin connected to the constant voltage module. A first end of the third inductor is connected to a S pin of the first converting chip. A second end of the third inductor is connected to the second voltage conversion unit.

The fifth LED has a positive end connected to the second end of the third inductor.

The negative end of the fifth LED passes the fourth capacitor connected to the first end of the third inductor, the negative end of the sixth LED is connected to the first end of the third inductor.

The positive end of the sixth LED passes the fifth capacitor connected to the second end of the third inductor, the positive end of the sixth LED is grounded.

The nineteenth resistor is connected between the negative end of the fifth LED and FB pin of the first converting chip. The twentieth resistor is connected between the first end of the third inductor and the FB pin of first converting chip.

In some embodiments, the rectifier module has a rectified bridge for rectifying the dimming voltage from dimmer to provide the rectified voltage.

In some embodiments, the lighting apparatus may also include a dimmer driver plate connected between the dimmer and the driver.

In some embodiments, the dimmer driver plate is plugged to a circuit board of the driver. Specifically, when a dimmer is used, related circuit components are placed on a dimmer driver plate, which is then installed, plugged or added to be combined with other components of the driver. With such design, it is flexible to provide a lighting apparatus with dimmer support or a lighting apparatus without dimmer support. Most components are the same, just the dimmer driver plate is not added.

In some embodiments, the driver detects whether the dimmer plate is plugged to switch to a corresponding operation function. Specifically, such design provides a flexible configuration. In addition, a detecting circuit is disposed in the driver to automatically detect whether to support the dimmer function by determining whether the dimmer driver plate is installed.

In some embodiments, the lighting apparatus may also include a driver box for containing the driver. The driver box has a first wiring area and a second wiring area, the first wiring area and the second wiring area are separated. The first wiring area is used for connecting a first wire from the dimmer and the second wiring area is used for connecting a second wire to the external power source. The dimmer uses a lower voltage while the external power source uses a higher voltage, e.g. 110V to 220V. With such design, it is safe for workers who need to install the lighting apparatuses.

In some embodiments, the lighting apparatus may also include a wireless module for receiving an external command from a remote device. The driver selects to use a control signal from the dimmer or the external command from the wireless module. There may be various configuration on integrating with external control, e.g. the wireless control from a remote control like a mobile phone or a home gateway running associated applications. For example, the external command may overwrite the control signal no matter whether the control signal is changed. In some other configuration, the external command may be used to interpret how to drive the light source also reference to the control signal.

In some embodiments, when the wireless command is converted to a PWM control signal. In such case, the wireless command is directly made as a PWM control signal to be sent to a power IC to generate a corresponding driving power according to the PWM control signal.

In some embodiments, the wireless module transmits the control signal to another lighting apparatus to adjust an intensity of said another lighting apparatus according to the external command. For example, a dimmer is disposed on a wall. When a user controls the dimmer, in addition to the lighting apparatus directly connected to the dimmer, another lighting apparatus that directly or indirectly communicates with the lighting apparatus with the dimmer may receive an external command from the lighting apparatus with the dimmer. The external command carries the manual operation on the dimmer. In other words, when users adjust the dimmer, two lighting apparatuses may be adjusted at the same time, even said another lighting apparatus is not directly connected to the dimmer.

In some embodiments, a control signal of the dimmer is used to adjust a color temperature of the light source. The driver may interpret the control signal to adjust another optical parameter, instead of just lighting intensity.

DETAILED DESCRIPTION

Figure 1:
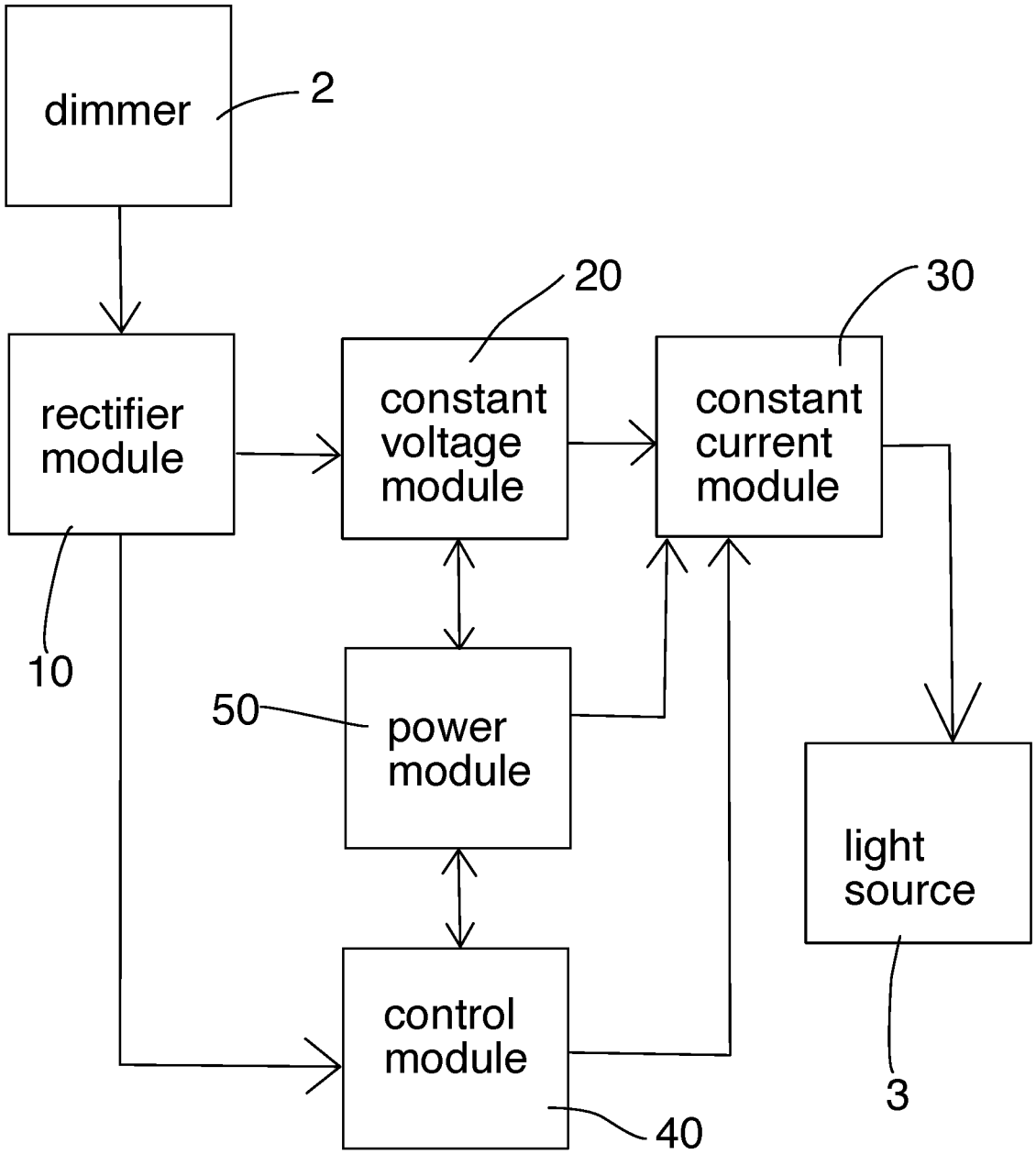
FIG. 1 illustrates a structure diagram of a lighting apparatus embodiment.

FIG. 1 shows a schematic structure diagram of a lighting apparatus connected to a dimmer and an external power source.

Please refer to FIG. 1. The lighting apparatus includes a light source 3 and a driver. The driver is connected between a dimmer 2 and a light source 3. The driver includes a rectifier module 10, a constant voltage module 20, a control module 40, a constant current module 30 and a power module 50. The light source 3 may be a LED light source plate mounted with multiple LED modules, multiple light strips mounted with LED modules or other light source devices that emit light when receiving proper driving current.

The rectifier module 10 is connected to the dimmer 1 for rectifying a dimming voltage to a rectified voltage. The constant voltage module 20 is connected to the rectifier module 10 for providing a first constant voltage power according to the rectified voltage.

The control module is connected to the rectifier module 10 for providing a control signal according to the rectified voltage. The control signal may be a PWM control signal for indicating a current device to generate a corresponding current according to the PWM control signal.

The constant current module 40 is connected to the constant voltage module 20 and the light source 3 for providing a constant current according to the control signal and the first constant voltage power.

The power module 50 is connected to the constant voltage module 20 for providing a supplied voltage according to the first constant voltage power source and providing electricity to every module.

The constant voltage module 20 efficiently suppresses every voltage drop or jittering produced by an alternating current power source network when inputting voltage in order to output a stable voltage and provides a stable input voltage to the constant current module 40. The control module 30 output the related control signal for controlling the constant current module 40 for outputting the current to the light source 3 at the same time to ensure a constant current. When the voltage drop or abnormal situation happens in the alternating current power source network, the LED light source 3 may remain constant brightness by not causing a change of the current inputted to the LED light source 3.

Figure 4:
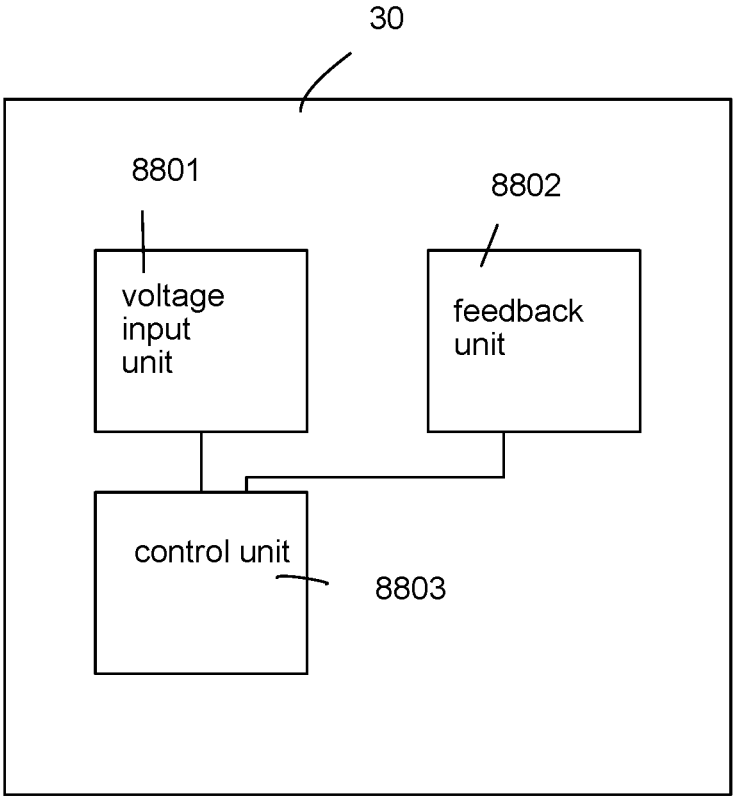
FIG. 4 shows a component used in the embodiment of FIG. 1.

Please also refer to FIG. 4. The control module 30 includes a voltage input unit 8801 connected to the rectifier module 10 for detecting the rectified voltage to provide voltage detection signal. The control module 30 also includes a feedback unit 8802 connected to the constant current module 40 for detecting the driving voltage to provide a feedback voltage. The control module 30 also includes a control unit 8803 connected to the voltage input unit and the feedback unit for providing the control signal according to the voltage detection signal and the feedback voltage.

Figure 2:
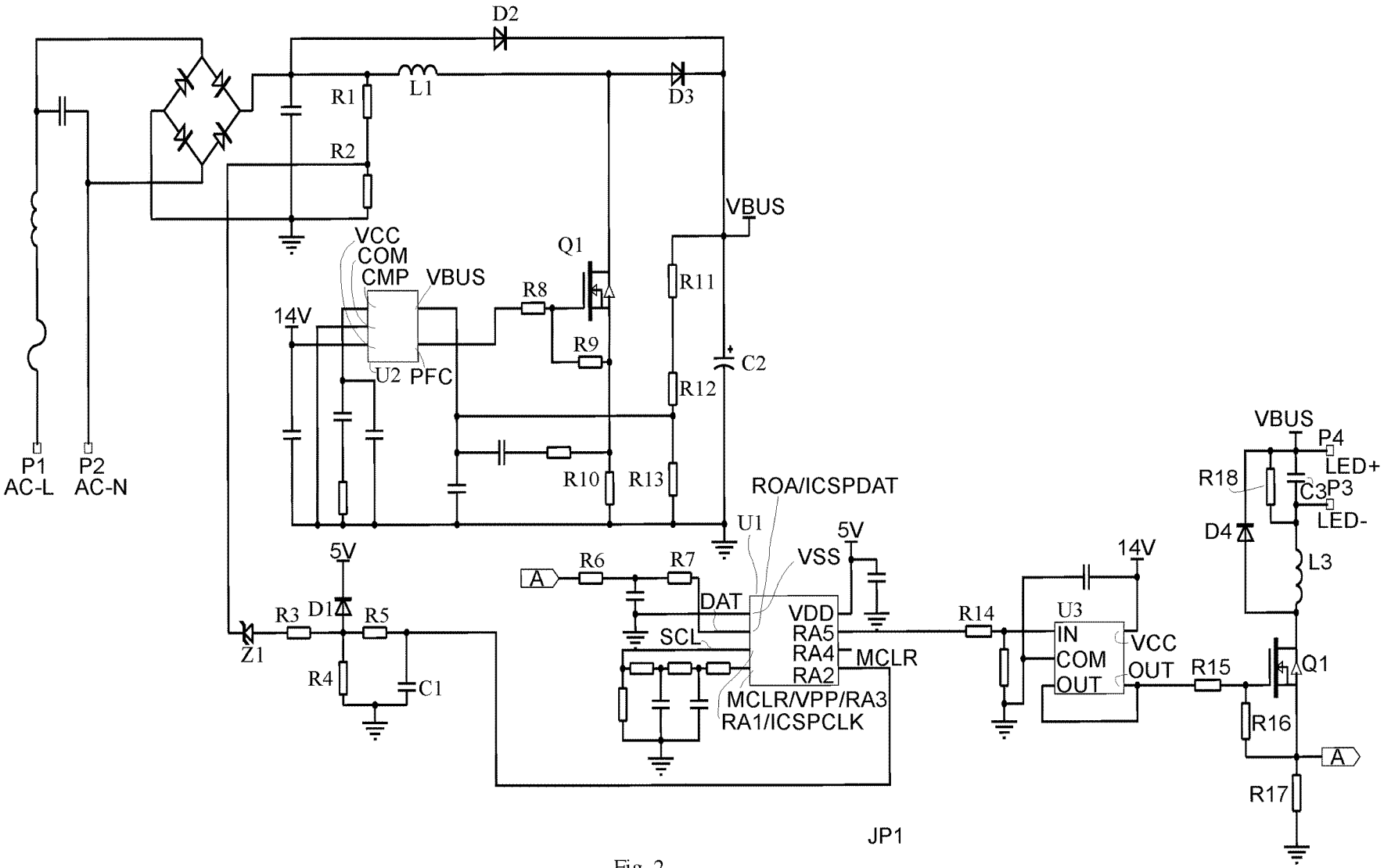
FIG. 2 shows a circuit diagram.
Figure 3:
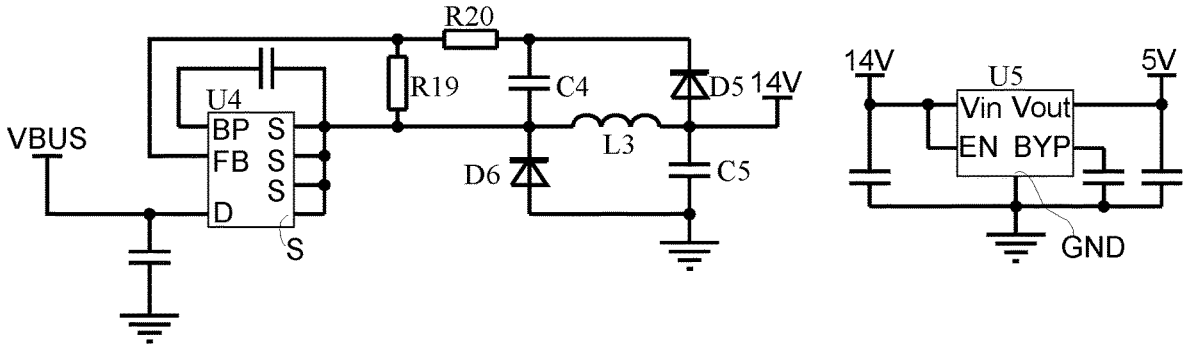
FIG. 3 shows another circuit diagram.

Please refer to FIG. 2 and FIG. 3. In an embodiment, the voltage input unit includes a first resistor R1, a second resistor R2, a third resistor R3, a fourth resistor R4, a fifth resistor R5, a first capacitor C1, a first LED D1 and a Zener diode Z1. The first resistor R1 and the second resistor R2 connected between the rectifier module 10 and ground. A negative end of Zener diode Z1 connected to a common end of the first resistor R1 and the second resistor R2. The third resister R3 and the fourth resister R4 connected between the negative end of the Zener diode Z1 and the ground. A first end of the fifth resistor R5 is connected to the positive end of the Zener diode Z1 through the third resistor R3. The first end of fifth resistor R5 is connected to the positive end of the Zener diode Z1 through the third resistor R3. The first end of the fifth resistor R5 is grounded through the fourth resistor R4. The negative end of the first LED D1 is connected to the power module 50. The positive end of the first LED is connected to the first end of the fifth resistor R5. The second end of the fifth resistor R5 is connected to the control unit U1. The first capacitor is connected to the second end of the fifth resistor R5 and the ground.

In an embodiment, the feedback unit includes a sixth resistor R6 and a seventh resistor R7. The sixth resistor R6 and the seventh resistor R7 is connected in series between the constant current module 40 and the control unit U1.

In an embodiment, the control unit U1 includes a modulus converter connected to the voltage input unit for transmitting the rectified voltage to a digital signal. The modulus converter is connected to the feedback unit for a controller providing control signal according to the digital signal and the feedback voltage.

In an embodiment, the constant voltage module 20 includes a constant voltage chip U2, an eighth resistor R8, a ninth resistor R9 a tenth resistor R10, a eleventh resistor R11, a twelfth resistor R12, a thirteenth resistor R13, a first inductor L1, a first transistor Q1, a second capacitor C2, a second LED D2 and a third LED D3. The first transistor Q1 has a gate connected to a PFC pin of the constant voltage chip U2 through the eighth resistor R8. The ninth resistor R9 is connected between the gate of the first transistor Q1 and an anode end of the first transistor Q1. A cathode end of the first transistor Q1 is connected to the rectifier module 10 through the first inductor L1. The tenth resistor R10 is connected between the anode end of first transistor Q1 and the ground. The thirteenth resistor R13 is connected to the VBUS pin of the constant voltage chip U2 and the ground. The eleventh resistor R11 and the twelfth resistor R12 is connected in series between a first end of the second capacitor C2 and the VBUS pin n of the constant voltage chip U2. The first end of the of the second capacitor C2 is connected to the negative end of the second LED D2. The positive end of the second LED D2 is connected to the rectifier module 10. The negative end of the third LED D3 is connected to the first end of the second capacitor C2. The positive end of the third LED is connected to the cathode end of the first transistor Q1. The second end of the second capacitor C2 is grounded. The second end of the second capacitor C2 is connected to the constant current module 40.

In an embodiment, the constant current module 40 includes a constant current chip U3, a second transistor Q2, a second inductor L2, a fourteenth resistor R14, a fifth resistor R15, a sixth resistor R16, a seventeenth resistor R17, an eighteenth resistor R18, a third capacitor C3 and a fourth LED D4. An input end of the constant current chip U3 is connected to the control module 30 through the fourteenth resistor R14. The power end of the constant current chip U3 is connected to the power module 50. The output end of the constant current chip U3 is connected to a gate of the second transistor Q2 through the fifteenth resistor R15. An anode end of the second transistor Q2 is grounded through the seventeenth resistor R17. The sixteenth resistor R16 is connected between the anode end of the second transistor Q2 and the gate of the second transistor Q2. The first end of the second inductor L2 is connected to the cathode of the second transistor Q2. The second end of the second inductor L2 passes the eighteenth resistor R18 connected to the constant voltage module 20. The first end of the third capacitor C3 is connected to the constant voltage module 20 and the anode of the LED light source. The second end of the third capacitor C3 is connected to the second end of the second inductor L2 and the negative end of the LED light source 3. The fourth LED D4 has a positive end connected to the cathode end of the second transistor Q2. The negative end of the fourth LED D4 is connected to the constant voltage module 20.

In an embodiment, the power module 50 includes a first voltage conversion unit connected to the constant voltage module 20 for converting the first constant voltage power source to a first voltage and a second voltage conversion unit connected to the first voltage conversion module for converting the first voltage to a second voltage.

In an embodiment, the first voltage conversion unit includes a first converting chip U4, a third inductor L3, a nineteenth resistor R19, a twentieth resistor R20, a fifth LED D5, a sixth LED D6, a fourth capacitor C4 and a fifth capacitor. The first converting chip U4 has a D pin connected to the constant voltage module 20. A first end of the third inductor L3 is connected to a S pin of the first converting chip U4. A second end of the third inductor L3 is connected to the second voltage conversion unit. The fifth LED D5 has a positive end connected to the second end of the third inductor L3. The negative end of the fifth LED D5 passes the fourth capacitor connected to the first end of the third inductor L3. The negative end of the sixth LED D6 is connected to the first end of the third inductor L3. The positive end of the sixth LED D6 passes the fifth capacitor C5 connected to the second end of the third inductor L3. The positive end of the sixth LED D6 is grounded. The nineteenth resistor R19 is connected between the negative end of the fifth LED D5 and FB pin of the first converting chip U4. The twentieth resistor R20 is connected between the first end of the third inductor L3 and the FB pin of first converting chip U4.

The above dimmer driver circuit passes through a rectified bridge in the rectifying circuit for rectifying the dimmer voltage output by the dimmer to provide a rectified voltage. A constant voltage chip U2 in the constant voltage module has a PCF pin outputting a control signal to switch off the first transistor Q1. The cathode end of the first transistor Q1 outputs a first constant voltage power source. The voltage input unit passes the first resistor R1 and the second resistor R2 for detecting the rectifying circuit to output the rectified voltage and passes the Zener diode Z1 to provide a voltage detection signal output to the input pin RA2 of the control unit U1. The input pin RA0 of the control unit U1 receives the feedback voltage from the anode end of the second transistor Q2. The control unit U1 provides the control signal according to the voltage detection signal and the feedback voltage and outputs to the input pin IN of the constant current module to the output pin RAS. The output pin of the constant current chip U3 controls to switch off the second transistor Q2 according to an output pin OUT of the constant current chip U3. The input pin D of the first conversion chip U4 of the first voltage conversion unit receives the first constant voltage power source output by the constant voltage module. The first constant voltage power source is being converted to the first voltage which is 14V. The input pin Vin of the second conversion pin of the second voltage conversion unit receives the first voltage and converts the first voltage which is 14V to the second voltage which is 5V then output through the input pin Vout of the second conversion pin. The first voltage provides the constant voltage chip U2 and the constant current chip U3 needed electricity and the second voltage provides the control module needed electricity.

Furthermore, a dimming driver plate is also provided. The dimming driver plate connected between the dimmer 1 and the LED light source 3. The dimming driver plate includes a circuit board and a dimmer driver circuit fixed to the circuit board.

In some embodiments, a lighting apparatus is connected to a dimmer and an external power source. The lighting apparatus includes a light source and a driver. The driver is used for converting the external power source to a driving current supplied to the light source. The driver includes a rectifier module, a constant voltage module, a control module, a constant current module, and a power module. The rectifier module is connected to the dimmer for rectifying a dimming voltage to a rectified voltage. The constant voltage module is connected to the rectifier module for providing a first constant voltage power according to the rectified voltage. The control module is connected to the rectifier module for providing a control signal according to the rectified voltage. The constant current module is connected to the constant voltage module and the light source for providing a constant current according to the control signal and the first constant voltage power. The power module is connected to the constant voltage module for providing a supplied voltage according to the first constant voltage power source.

In some embodiments, the constant voltage module suppresses a voltage drop caused by an alternating current power source network. For example, the lighting apparatus is connected to a 110V/220V alternating power source. In some areas, the power may be unstable and sometimes there is voltage drop. When such voltage drop occurs, the dimmer is directly affected and sends an incorrect adjustment to the driver and consequently the light source is controlled to act abnormally, causing unpleasant visual effect. The constant voltage module keeps the influence of the voltage drop away from the light source even with a dimmer aside.

In some embodiments, the control signal is a PWM (Pulse Width Modulation) control signal.

In some embodiments, the control module includes a voltage input unit, a feedback unit and a control unit. The voltage input unit is connected to the rectifier module for detecting the rectified voltage to provide voltage detection signal. The feedback unit is connected to the constant current module for detecting the driving voltage to provide a feedback voltage. The control unit is connected to the voltage input unit and the feedback unit for providing the control signal according to the voltage detection signal and the feedback voltage.

In some embodiments, the feedback unit includes a sixth resistor and a seventh resistor. The sixth resistor and the seventh resistor are connected in series between the constant current module and the control unit.

In some embodiments, the feedback unit includes a sixth resistor and a seventh resistor. The sixth resistor and the seventh resistor are connected in series between the constant current module and the control unit.

In some embodiments, the control unit includes a modulus converter connected to the voltage input unit for transmitting the rectified voltage to a digital signal. The modulus converter is connected to the feedback unit for a controller providing control signal according to the digital signal and the feedback voltage.

In some embodiments, the constant voltage module includes a constant voltage chip, an eighth resistor, a ninth resistor, a tenth resistor, an eleventh resistor, a twelfth resistor, a thirteenth resistor, a first inductor, a first transistor, a second capacitor, a second LED and a third LED. The first transistor has a gate connected to a PFC (power factor correction) pin of the constant voltage chip through the eighth resistor. The ninth resistor is connected between the gate of the first transistor and an anode end of the first transistor. A cathode end of the first transistor is connected to the rectifier module through the first inductor.

The tenth resistor is connected between the anode end of first transistor and the ground, the thirteenth resistor is connected to the VBUS pin of the constant voltage chip and the ground.

The eleventh resistor and the twelfth resistor are connected in series between a first end of the second capacitor and the VBUS pin of the constant voltage chip. The first end of the of the second capacitor is connected to the negative end of the second LED. The positive end of the second LED is connected to the rectifier module. The negative end of the third LED is connected to the first end of the second capacitor, the positive end of the third LED is connected to the cathode end of the first transistor.

The second end of the second capacitor is grounded. The second end of the second capacitor is connected to the constant current module.

In some embodiments, the constant current module includes a constant current chip, a second transistor, a second inductor, a fourteenth resistor, a fifth resistor, a sixth resistor, a seventeenth resistor, an eighteenth resistor, a third capacitor and a fourth LED.

An input end of the constant current chip is connected to the control module through the fourteenth resistor. The power end of the constant current chip is connected to the power module, the output end of the constant current chip is connected to a gate of the second transistor through the fifteenth resistor. An anode end of the second transistor is grounded through the seventeenth resistor.

The sixteenth resistor is connected between the anode end of the second transistor and the gate of the second transistor.

The first end of the second inductor is connected to the cathode of the second transistor. The second end of the second inductor passes the eighteenth resistor connected to the constant voltage module. The first end of the third capacitor is connected to the constant voltage module and the anode of the LED light source. The second end of the third capacitor is connected to the second end of the second inductor and the negative end of the LED light source. The fourth LED has a positive end connected to the cathode end of the second transistor. The negative end of the fourth LED is connected to the constant voltage module 20.

In some embodiments, the power module includes a first voltage conversion unit connected to the constant voltage module for converting the first constant voltage power source to a first voltage and a second voltage conversion unit connected to the first voltage conversion module for converting the first voltage to a second voltage.

In some embodiments, the first voltage conversion unit includes a first converting chip, a third inductor, a nineteenth resistor, a twentieth resistor, a fifth LED, a sixth LED, a fourth capacitor and a fifth capacitor. The first converting chip has a D pin connected to the constant voltage module. A first end of the third inductor is connected to a S pin of the first converting chip. A second end of the third inductor is connected to the second voltage conversion unit.

The fifth LED has a positive end connected to the second end of the third inductor.

The negative end of the fifth LED passes the fourth capacitor connected to the first end of the third inductor, the negative end of the sixth LED is connected to the first end of the third inductor.

The positive end of the sixth LED passes the fifth capacitor connected to the second end of the third inductor, the positive end of the sixth LED is grounded.

The nineteenth resistor is connected between the negative end of the fifth LED and FB pin of the first converting chip. The twentieth resistor is connected between the first end of the third inductor and the FB pin of first converting chip.

In some embodiments, the rectifier module has a rectified bridge for rectifying the dimming voltage from dimmer to provide the rectified voltage.

Figure 5:
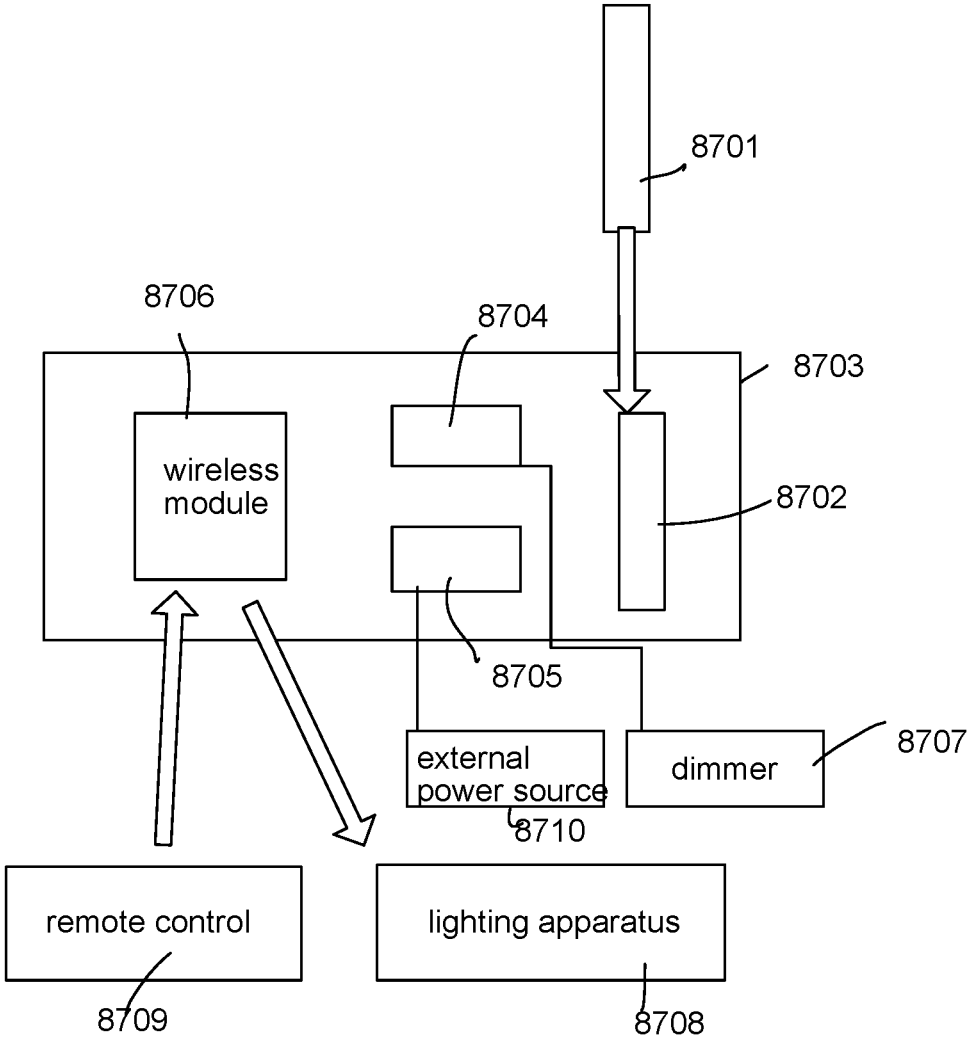
FIG. 5 shows an example on how to adjust the embodiments.

In FIG. 5, the lighting apparatus may also include a dimmer driver plate 8701 connected between the dimmer and the driver.

In some embodiments, the dimmer driver plate 8701 is plugged to a socket 8702 on a circuit board of the driver. Specifically, when a dimmer is used, related circuit components are placed on a dimmer driver plate 8701, which is then installed, plugged or added to be combined with other components of the driver. With such design, it is flexible to provide a lighting apparatus with dimmer support or a lighting apparatus without dimmer support. Most components are the same, just the dimmer driver plate is not added.

In some embodiments, the driver detects whether the dimmer plate is plugged to switch to a corresponding operation function. Specifically, such design provides a flexible configuration. In addition, a detecting circuit is disposed in the driver to automatically detect whether to support the dimmer function by determining whether the dimmer driver plate is installed.

In FIG. 5, the lighting apparatus may also include a driver box 8703 for containing the driver. The driver box 8703 has a first wiring area 8704 and a second wiring area 8705, the first wiring area 8704 and the second wiring area 8705 are separated. The first wiring area 8704 is used for connecting a first wire from the dimmer and the second wiring area 8705 is used for connecting a second wire to the external power source 8710. The dimmer 8707 uses a lower voltage while the external power source uses a higher voltage, e.g. 110V to 220V. With such design, it is safe for workers who need to install the lighting apparatuses.

In FIG. 5, the lighting apparatus may also include a wireless module 8706 for receiving an external command from a remote device as a remote control 8709. The driver selects to use a control signal from the dimmer 8707 or the external command from the wireless module 8706. There may be various configuration on integrating with external control, e.g. the wireless control from a remote control like a mobile phone or a home gateway running associated applications. For example, the external command may overwrite the control signal no matter whether the control signal is changed. In some other configuration, the external command may be used to interpret how to drive the light source also reference to the control signal.

In some embodiments, when the wireless command is converted to a PWM control signal. In such case, the wireless command is directly made as a PWM control signal to be sent to a power IC to generate a corresponding driving power according to the PWM control signal.

In FIG. 5, the wireless module transmits the control signal to another lighting apparatus 8708 to adjust an intensity of said another lighting apparatus 8708 according to the external command. For example, a dimmer 8707 is disposed on a wall. When a user controls the dimmer 8707, in addition to the lighting apparatus directly connected to the dimmer, another lighting apparatus 8708 that directly or indirectly communicates with the lighting apparatus with the dimmer 8707 may receive an external command from the lighting apparatus with the dimmer 8707. The external command carries the manual operation on the dimmer. In other words, when users adjust the dimmer, two lighting apparatuses may be adjusted at the same time, even said another lighting apparatus is not directly connected to the dimmer.

In some embodiments, a control signal of the dimmer is used to adjust a color temperature of the light source. The driver may interpret the control signal to adjust another optical parameter, instead of just lighting intensity.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A lighting apparatus, connecting to a dimmer and an external power source, comprising:

a light source; and a driver for converting the external power source to a driving current supplied to the light source, the driver comprising a rectifier module, a constant voltage module, a control module, a constant current module, and a power module, wherein the rectifier module is connected to the dimmer for rectifying a dimming voltage to a rectified voltage, the constant voltage module is connected to the rectifier module for providing a first constant voltage power according to the rectified voltage, the control module is connected to the rectifier module for providing a control signal according to the rectified voltage, the constant current module is connected to the constant voltage module and the light source for providing a constant current according to the control signal and the first constant voltage power, the power module is connected to the constant voltage module for providing a supplied voltage according to the first constant voltage power source.

2. The lighting apparatus of claim 1, wherein the constant voltage module suppresses a voltage drop caused by an alternating current power source network.

3. The lighting apparatus of claim 1, wherein the control signal is a PWM (Pulse Width Modulation) control signal.

4. The lighting apparatus of claim 1, wherein the control module includes a voltage input unit, a feedback unit and a control unit, the voltage input unit is connected to the rectifier module for detecting the rectified voltage to provide voltage detection signal, the feedback unit is connected to the constant current module for detecting the driving voltage to provide a feedback voltage, the control unit is connected to the voltage input unit and the feedback unit for providing the control signal according to the voltage detection signal and the feedback voltage.

5. The lighting apparatus of claim 4, wherein the feedback unit includes a sixth resistor and a seventh resistor, the sixth resistor and the seventh resistor are connected in series between the constant current module and the control unit.

6. The lighting apparatus of claim 4, wherein the feedback unit includes a sixth resistor and a seventh resistor, the sixth resistor and the seventh resistor are connected in series between the constant current module and the control unit.

7. The lighting apparatus of claim 4, wherein the control unit includes a modulus converter connected to the voltage input unit for transmitting the rectified voltage to a digital signal, the modulus converter is connected to the feedback unit for a controller providing control signal according to the digital signal and the feedback voltage.

8. The lighting apparatus of claim 1, wherein the constant voltage module includes a constant voltage chip, an eighth resistor, a ninth resistor, a tenth resistor, an eleventh resistor, a twelfth resistor, a thirteenth resistor, a first inductor, a first transistor, a second capacitor, a second LED and a third LED, the first transistor has a gate connected to a PFC pin of the constant voltage chip through the eighth resistor, the ninth resistor is connected between the gate of the first transistor and an anode end of the first transistor, a cathode end of the first transistor is connected to the rectifier module through the first inductor, the tenth resistor is connected between the anode end of first transistor and the ground, the thirteenth resistor is connected to the VBUS pin of the constant voltage chip and the ground, the eleventh resistor and the twelfth resistor are connected in series between a first end of the second capacitor and the VBUS pin of the constant voltage chip, the first end of the of the second capacitor is connected to the negative end of the second LED, the positive end of the second LED is connected to the rectifier module, the negative end of the third LED is connected to the first end of the second capacitor, the positive end of the third LED is connected to the cathode end of the first transistor, the second end of the second capacitor is grounded, the second end of the second capacitor is connected to the constant current module.

9. The lighting apparatus of claim 1, wherein the constant current module includes a constant current chip, a second transistor, a second inductor, a fourteenth resistor, a fifth resistor, a sixth resistor, a seventeenth resistor, an eighteenth resistor, a third capacitor and a fourth LED, an input end of the constant current chip is connected to the control module through the fourteenth resistor, the power end of the constant current chip is connected to the power module, the output end of the constant current chip is connected to a gate of the second transistor through the fifteenth resistor, an anode end of the second transistor is grounded through the seventeenth resistor, the sixteenth resistor is connected between the anode end of the second transistor and the gate of the second transistor, the first end of the second inductor is connected to the cathode of the second transistor, the second end of the second inductor passes the eighteenth resistor connected to the constant voltage module, the first end of the third capacitor is connected to the constant voltage module and the anode of the LED light source, the second end of the third capacitor is connected to the second end of the second inductor and the negative end of the LED light source, the fourth LED has a positive end connected to the cathode end of the second transistor, the negative end of the fourth LED is connected to the constant voltage module 20.

10. The lighting apparatus of claim 1, wherein the power module includes a first voltage conversion unit connected to the constant voltage module for converting the first constant voltage power source to a first voltage and a second voltage conversion unit connected to the first voltage conversion module for converting the first voltage to a second voltage.

11. The lighting apparatus of claim 1, wherein the first voltage conversion unit includes a first converting chip, a third inductor, a nineteenth resistor, a twentieth resistor, a fifth LED, a sixth LED, a fourth capacitor and a fifth capacitor, the first converting chip has a D pin connected to the constant voltage module, a first end of the third inductor is connected to a S pin of the first converting chip, a second end of the third inductor is connected to the second voltage conversion unit, the fifth LED has a positive end connected to the second end of the third inductor, the negative end of the fifth LED passes the fourth capacitor connected to the first end of the third inductor, the negative end of the sixth LED is connected to the first end of the third inductor, the positive end of the sixth LED passes the fifth capacitor connected to the second end of the third inductor, the positive end of the sixth LED is grounded, the nineteenth resistor is connected between the negative end of the fifth LED and FB pin of the first converting chip, the twentieth resistor is connected between the first end of the third inductor and the FB pin of first converting chip.

12. The lighting apparatus of claim 1, wherein the rectifier module has a rectified bridge for rectifying the dimming voltage from dimmer to provide the rectified voltage.

13. The lighting apparatus of claim 1, further comprising a dimmer driver plate connected between the dimmer and the driver.

14. The lighting apparatus of claim 1, wherein the dimmer driver plate is plugged to a circuit board of the driver.

15. The lighting apparatus of claim 14, wherein the driver detects whether the dimmer plate is plugged to switch to a corresponding operation function.

16. The lighting apparatus of claim 1, further comprising a driver box for containing the driver, the driver box has a first wiring area and a second wiring area, the first wiring area and the second wiring area are separated, the first wiring area is used for connecting a first wire from the dimmer and the second wiring area is used for connecting a second wire to the external power source.

17. The lighting apparatus of claim 1, further comprising a wireless module for receiving an external command from a remote device, the driver selects to use a control signal from the dimmer or the external command from the wireless module.

18. The lighting apparatus of claim 17, wherein when the wireless command is converted to a PWM control signal.

19. The lighting apparatus of claim 17, wherein the wireless module transmits the control signal to another lighting apparatus to adjust an intensity of said another lighting apparatus according to the external command.

20. The lighting apparatus of claim 1, wherein a control signal of the dimmer is used to adjust a color temperature of the light source.

* * * * *